US011074850B2

(12) United States Patent
Hu et al.

(10) Patent No.: US 11,074,850 B2
(45) Date of Patent: Jul. 27, 2021

(54) DISPLAY PANEL, METHOD FOR GENERATING A GRAY-SCALE VOLTAGE METHOD THEREOF, AND A COMPUTER-READABLE STORAGE MEDIUM

(71) Applicant: HKC Corporation Limited, Guangdong (CN)

(72) Inventors: Shuixiu Hu, Guangdong (CN); Dongsheng Guo, Guangdong (CN)

(73) Assignee: HKC Corporation Limited, Shenzhen (CN)

( * ) Notice: Subject to any disclaimer, the term of this patent is extended or adjusted under 35 U.S.C. 154(b) by 0 days.

(21) Appl. No.: 17/041,003

(22) PCT Filed: Nov. 21, 2018

(86) PCT No.: PCT/CN2018/116674
§ 371 (c)(1),
(2) Date: Sep. 24, 2020

(87) PCT Pub. No.: WO2020/087591
PCT Pub. Date: May 7, 2020

(65) Prior Publication Data

US 2021/0097925 A1 Apr. 1, 2021

(30) Foreign Application Priority Data

Nov. 1, 2018 (CN) ..... 201811293577.0

(51) Int. Cl.
*G09G 3/20* (2006.01)
*G09G 3/36* (2006.01)

(52) U.S. Cl.
CPC ..... *G09G 3/2007* (2013.01); *G09G 3/3611* (2013.01); *G09G 2320/0276* (2013.01); *G09G 2320/0673* (2013.01)

(58) Field of Classification Search
CPC ..... G09G 3/2007; G09G 3/3611; G09G 2320/0276; G09G 2320/0673;
(Continued)

(56) References Cited

U.S. PATENT DOCUMENTS 9,390,645 B2 * 7/2016 Choi ..... G09G 3/20
9,704,425 B2 * 7/2017 Zhang ..... G09G 3/006
(Continued)

FOREIGN PATENT DOCUMENTS

CN 1834742 A 9/2006
CN 101097704 A 1/2008
(Continued)

OTHER PUBLICATIONS

International Search Report of PCT Patent Application No. PCT/CN2018/116674 dated Jul. 31, 2019.
(Continued)

*Primary Examiner* — Michael J Jansen, II

(57) ABSTRACT

Disclosed is a method for generating gray-scale voltage of display panel, which includes: generating, by a data source integrate circuit, a preset number of gamma voltages according to a target analog voltage(S10); and generating the gray-scale voltage of the display panel in accordance with each gamma voltage (S20).

18 Claims, 2 Drawing Sheets

(58) Field of Classification Search
CPC .... G09G 2360/18; G09G 3/2092; G09G 3/20; G09G 2360/16
See application file for complete search history.

(56) References Cited

U.S. PATENT DOCUMENTS

| | | | | |
|---|---|---|---|---|
| 9,704,427 | B2 * | 7/2017 | Huang | G09G 3/2007 |
| 9,805,674 | B2 * | 10/2017 | Syu | G09G 3/3648 |
| 10,269,286 | B2 * | 4/2019 | Zhang | G09G 3/2074 |
| 10,332,463 | B2 * | 6/2019 | Hao | G09G 3/3607 |
| 10,460,682 | B2 * | 10/2019 | Chen | G09G 3/3607 |
| 10,832,625 | B2 * | 11/2020 | Wang | G09G 3/3611 |
| 2015/0109348 | A1 | 4/2015 | Hikichi et al. | |
| 2015/0187303 | A1 * | 7/2015 | Choi | G09G 3/20 345/691 |
| 2015/0243198 | A1 * | 8/2015 | Zhang | G09G 3/006 345/690 |
| 2016/0133192 | A1 | 5/2016 | Chae et al. | |
| 2016/0173862 | A1 * | 6/2016 | Huang | G09G 3/2003 348/51 |
| 2016/0351139 | A1 * | 12/2016 | Syu | G09G 3/36 |
| 2017/0278448 | A1 * | 9/2017 | Zhang | G09G 3/2074 |
| 2018/0096662 | A1 * | 4/2018 | Lee | G09G 3/3614 |
| 2018/0204522 | A1 * | 7/2018 | Furihata | G09G 3/3275 |
| 2018/0330680 | A1 * | 11/2018 | Chen | G09G 3/3607 |
| 2018/0374434 | A1 * | 12/2018 | Hao | G09G 3/3607 |
| 2019/0043433 | A1 * | 2/2019 | Chen | G09G 3/36 |
| 2019/0266968 | A1 * | 8/2019 | Wang | G09G 3/006 |
| 2020/0160801 | A1 * | 5/2020 | Wang | G09G 3/36 |
| 2020/0410918 | A1 * | 12/2020 | Gai | G09G 3/2003 |
| 2021/0012693 | A1 * | 1/2021 | Hu | G09G 3/006 |

FOREIGN PATENT DOCUMENTS

| | | | |
|---|---|---|---|
| CN | 101178886 | A | 5/2008 |
| CN | 102436789 | A | 5/2012 |
| CN | 103310757 | A | 9/2013 |
| CN | 103985347 | A | 8/2014 |
| CN | 105139885 | A | 12/2015 |
| CN | 105741805 | A | 7/2016 |
| CN | 106297690 | A | 1/2017 |
| CN | 106297703 | A | 1/2017 |
| CN | 107564484 | A | 1/2018 |
| CN | 107610657 | A | 1/2018 |

OTHER PUBLICATIONS

1st Office Action of counterpart Chinese Patent Application No. 201811293577.0 dated Feb. 3, 2020.

2nd Office Action of counterpart Chinese Patent Application No. 201811293577.0 dated Jul. 29, 2020.

* cited by examiner

DISPLAY PANEL, METHOD FOR GENERATING A GRAY-SCALE VOLTAGE METHOD THEREOF, AND A COMPUTER-READABLE STORAGE MEDIUM

CROSS-REFERENCE TO RELATED APPLICATION

This present disclosure claims priority to Chinese Patent Application with No. 201811293577.0, entitled "Display Panel and Gray-scale Voltage Generating Method thereof as well as Computer-readable Storage Medium" filed on Nov. 1, 2018, which is incorporated herein by reference in its entirety.

TECHNICAL FIELD

This present disclosure relates to the technical field of display panel, and particularly, to a display panel and the gray-scale voltage generating method thereof, and a computer-readable storage medium.

BACKGROUND

A display panel requires numerous voltages as reference voltage which is referred to as 'gamma voltage'. The display panel can generate all the gray-scale voltages required by display panel in accordance with reference voltage.

In an exemplary technology, gamma voltages needs to be generated by a separate gamma integrate circuit; in addition, these gamma voltages way also occupy the lead of data source integrate circuit, leading to a higher cost for producing the gamma voltage of display panel.

SUMMARY

It is the main objective of the present disclosure to provide a display panel and the gray-scale voltage generating method thereof as well as a computer-readable storage medium, which aim to solve the problem that the production cost of the gamma voltage of display panel is relatively high.

To achieve the foregoing objective, this present disclosure provides a method for generating the gray-scale voltage of display panel including the following operation:

generating, by a data source integrate circuit, a preset number of gamma voltages according to a target analog voltage when an inputted target analog voltage is detected; and generating the gray-scale voltage of the display panel in accordance with each gamma voltage.

To achieve the purpose above, this application also provides a display panel including a data source integrate circuit including at least one processor and a storage device, and the memory is stored with a computer-executable command that can be executed by at least one processor, and when the computer-executable command is executed by at least one processor, one processor will execute the following operations of:

generating, by a data source integrate circuit, a preset number of gamma voltages according to a target analog voltage when an inputted target analog voltage is detected; and generating the gray-scale voltage of the display panel in accordance with each gamma voltage.

To achieve the above objective, this application also provides a computer-readable storage medium stored with a computer-executable command that can be executed by at least one processor, and when the computer-executable command is executed by at least one processor, one processor will execute the following operations of:

generating, by a data source integrate circuit, a preset number of gamma voltages according to a target analog voltage when an inputted target analog voltage is detected; and generating the gray-scale voltage of the display panel in accordance with each gamma voltage.

In the display panel and the gray-scale voltage generating method thereof as well as the computer-readable storage medium provided by the present disclosure, the data source integrate circuit in the display panel generates a preset number of gamma voltages according to target analog voltage when an inputted target analog voltage is detected, and generates the gray-scale voltage of the display panel in accordance with each gamma voltage; the data source integrate circuit generates gamma voltage according to analog voltage, thus there is no need to use the gamma integrate circuit for generating gamma voltage and the gamma voltage will not occupy the lead in the data source integrate circuit, leading to a low cost for generating gamma voltage.

The object realization, function characteristics and advantages of this application will be further described with reference to embodiments and accompanying drawings.

DETAILED DESCRIPTION OF THE EMBODIMENTS

It should be understood that the embodiments described herein are only used to explain this application rather than limiting it.

The main solution of the embodiment of this application is that a data source integrate circuit generates a preset number of gamma voltages according to target analog voltage when an inputted target analog voltage is detected, and the gray-scale voltage of the display panel is generated in accordance with each gamma voltage.

The gamma voltage needs to be generated by a separate gamma integrate circuit; in addition, these gamma voltages need to occupy the lead of data source integrate circuit, thus the cost for producing the gamma voltage of display panel is relatively high.

This application provides a solution: the data source integrate circuit generates gamma voltages according to target analog voltage, thus there is no need to dispose the gamma integrate circuit for generating gamma voltage and the gamma voltage will not occupy the lead in the data source integrate circuit, leading to a low cost for generating gamma voltage.

Figure 1:
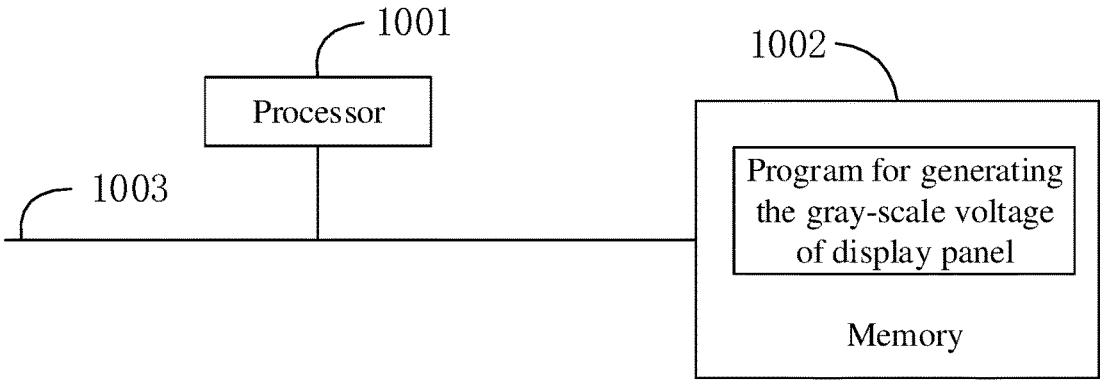
FIG. 1 is a schematic diagram of a hardware structure of a display panel of the present disclosure.

As a solution, the hardware structure of display panel may be as shown by FIG. 1.

The solution of the embodiment of this application provides a display panel including a processor 1001 such as CPU, a memory 1002 and a communication bus 1003. The communication bus 1003 is configured to realize connection and communication between the assemblies.

The memory 1002 may be a high-speed RAM (random access memory) or a stable memory (non-volatile memory) such as a disk memory. As shown in FIG. 1, as a computer storage medium, the memory 1003 may include a program for generating the gray-scale voltage of display panel; the processor 1001 may configured to call the program for generating the gray-scale voltage of display panel and execute the following operations:

generating, by the data source integrate circuit, a preset number of gamma voltages according to a target analog voltage when the inputted target analog voltage is detected; and generating the gray-scale voltage of the display panel in accordance with each gamma voltage.

Optionally, the processor 1001 may be configured to call the program for generating the gray-scale voltage of display panel stored on the memory 1002 and execute the following operations:

inputting the target analog voltage to the digital controller so that the digital controller generates a preset number of gamma voltages according to the target analog voltage.

Optionally, the processor 1001 may be configured to call the program for generating the gray-scale voltage of display panel stored on the memory 1002 and execute the following operations:

writing into the digital controller the relationship between the target analog voltage and the gamma voltages preset with a sequence number as well as the difference value between two gamma voltages with their sequence number adjacent to each other.

Optionally, the processor 1001 may be configured to call the program for generating the gray-scale voltage of display panel stored on the memory 1002 and execute the following operations:

determining the difference value between the two gamma voltages with their sequence number adjacent to each other, and acquiring the relationship between the target analog voltage and the gamma voltages preset with sequence number;

determining the parameter of the gamma voltage generating circuit according to the voltage difference value and the relationship;

causing the gamma voltage generating circuit to run according to determined parameter, and inputting the target analog voltage to the gamma voltage generating circuit to generate a preset number of gamma voltages so that the gamma voltage generating circuit generates a preset number of gamma voltages according to the voltage difference value and the relationship.

Optionally, the processor 1001 may be configured to call the program for generating the gray-scale voltage of display panel stored on the memory 1002 and execute the following operations:

judging whether the currently-inputted target analog voltage has changed or not according to the currently-inputted target analog voltage and previously-inputted target analog voltage; and executing the voltage difference value between the two gamma voltages with their sequence number adjacent to each other and acquiring the relationship between the target analog voltage and the gamma voltages preset with sequence number if the currently-inputted target analog voltage has not changed.

Optionally, the processor 1001 may be configured to call the program for generating the gray-scale voltage of display panel stored on the memory 1002 and execute the following operations:

determining the difference value between the two gamma voltages with their sequence number adjacent to each other and updating the relationship between the current target analog voltage and the gamma voltages preset with sequence number so as to update the parameter generated by the gamma voltage;

causing the gamma voltage generating circuit to run according to the updated parameter, and inputting the target analog voltage to the gamma voltage generating circuit so as to generated a preset number of gamma voltages.

Optionally, the processor 1001 may be configured to call the program for generating the gray-scale voltage of display panel stored on the memory 1002 and execute the following operations:

The operation of generating the gray-scale voltage of display panel according to each of the gamma voltages includes:

inputting each of the gamma voltages to the resistance string of the data source integrate circuit so as to generate the gray-scale voltage of display panel.

Optionally, the processor 1001 may be configured to call the program for generating the gray-scale voltage of display panel stored on the memory 1002 and execute the following operations:

The target analog voltage is a half of the analog voltage.

According to the foregoing solution of this embodiment, the data source integrate circuit in the display panel will generate a preset number of gamma voltages according to target analog voltage when an inputted target analog voltage is detected, and generate the gray-scale voltage of the display panel in accordance with each gamma voltage; the data source integrate circuit generates gamma voltage according to analog voltage, thus there is no need to use the gamma integrate circuit for generating gamma voltage and the gamma voltage will not occupy the lead in the data source integrate circuit, leading to a low cost for generating gamma voltage.

Based on the foregoing hardware framework, an embodiment of the method for generating the gray-scale voltage of display panel of this application is proposed.

Figure 2:
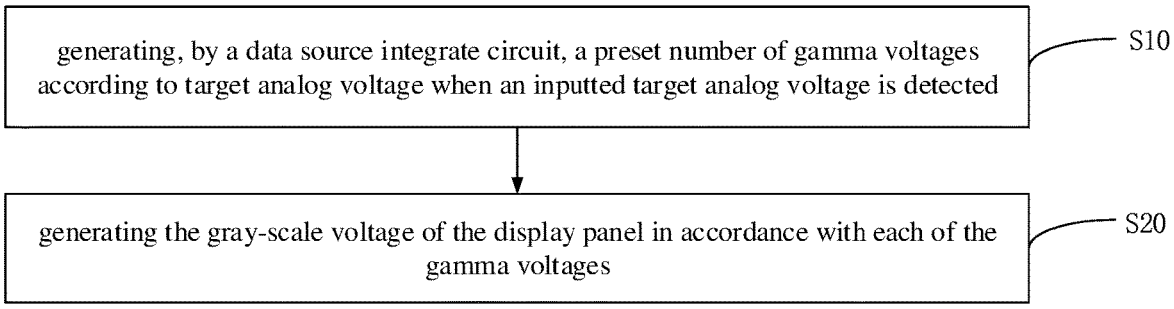
FIG. 2 is a schematic flow chart of a method for generating the gray-scale voltage of display panel according to an embodiment of the present disclosure.

In reference to FIG. 2 which is the $1^{st}$ embodiment of the method for generating the gray-scale voltage of display panel of this application, the method for generating the gray-scale voltage of display panel includes the following operations:

S10, generating, by a data source integrate circuit, a preset number of gamma voltages according to target analog voltage when an inputted target analog voltage is detected;

In this application, the display panel refers to a liquid crystal display panel. The display panel requires a plurality of gray-scale voltages to cause liquid crystal molecule to deflect accordingly so that the display panel will display a screen corresponding to image signal.

The display panel includes thin film transistor array substrate, i.e. TFT (Thin Film Transistor) array substrate provided with a TCON (Timer Control Register) plate capable of generating analog voltage; in this application, the analog voltage is set as continuous and stable voltage. The TCON plate can input the analog voltage as target analog voltage to the data source integrate circuit (source integrate circuit), i.e., source IC (source integrated circuit) in the TFT array substrate so that the source IC can generate a preset number of gamma voltages according to the target analog voltage, and the preset number may be any proper value, and optionally 14. Each gamma voltage has a corresponding sequence number such as Gamma 1 (the $1^{st}$ gamma voltage), Gamma 2, etc.; there is a voltage difference value between the two gamma voltages with their sequence numbers adjacent to each other, and the voltage difference value may change within a proper range, i.e. artisans may adjust the voltage difference value upon request. It should be noted that the requirement on the stability of target analog voltage is relatively high, so the analog voltage generated on the TCON plate will be processed to obtain a half-voltage analog voltage which will be inputted to the Source IC as target analog voltage, and the stability of the half-voltage analog voltage is superior to that of the analog voltage.

The Source IC is provided with a digital controller (Digital control) equipped with a program for generating gamma voltage, and in the form of external code programming, artisans write into the digital controller the relationship between the target analog voltage and the gamma voltages preset with sequence number as well as the voltage difference value between the two gamma voltages with their sequence numbers adjacent to each other, so that the digital controller will generate a preset number of gamma voltages in the form of numbers from target analog voltage via programming when the input of target analog voltage is detected; the preset number is usually 14, thus the digital controller will set 14 programming addresses in accordance with the relationship between the target analog voltage and the gamma voltages preset with sequence number as well as the voltage difference value between the two gamma voltages with their sequence number adjacent to each other, so that the digital controller will generate 14 gamma voltages via 14 programming addresses. It should be noted that the relationship between the target analog voltage and the gamma voltages preset with sequence number is Gamma 7>HAVDD>Gamma 8, and HAVDD is half-voltage analog voltage.

It can be understood that the digital controller can generate a preset number of gamma voltages after the Source IC inputs the target analog voltage to the digital controller.

S20, generating the gray-scale voltage of the display panel in accordance with each of the gamma voltages.

The source IC is provided with resistance string, and when the digital controller generates gamma voltage, the source IC will input the gamma voltage to the resistance string so as to divide the gamma voltage according to the voltage in the resistance string and obtain a plurality of gray-scale voltages; thereby, the source IC can generate all the gray-scale voltages of display panel in accordance with a preset number of gamma voltages.

In this application, gamma voltages are generated via source IC, and thereby there is no need to dispose a gamma IC for generating gamma voltage; thus, it is not necessary for gamma voltages to occupy the leads of source IC, reducing the number of leads of source IC and realizing a low cost for generating gamma voltages of this application.

In this application, gamma voltages are generated via source IC, and thereby there is no need to dispose a gamma IC for generating gamma voltage; thus, it is not necessary for gamma voltages to occupy the leads of source IC, reducing the number of leads of source IC and realizing a low cost for generating gamma voltages of this application.

Figure 3:
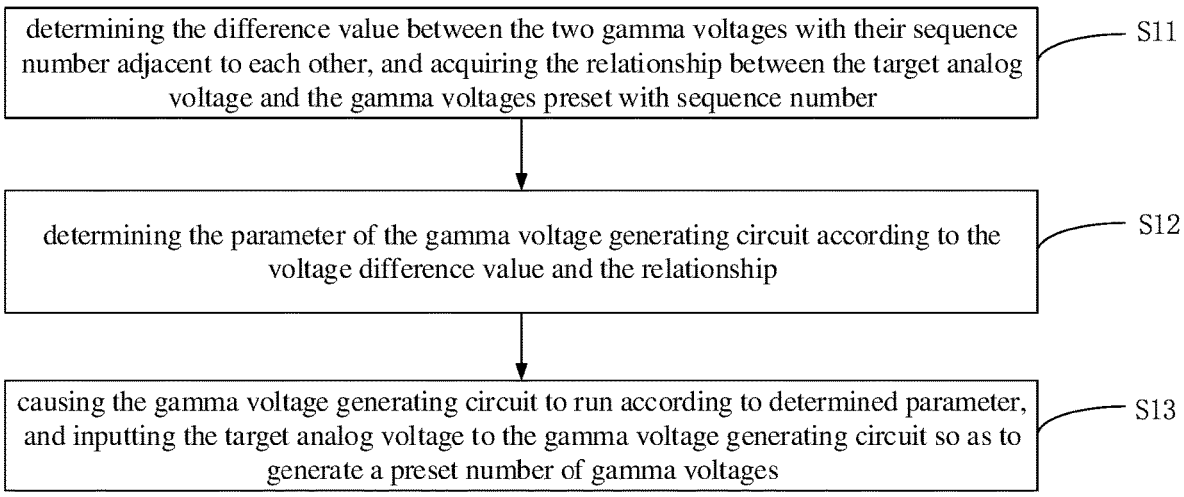
FIG. 3 is a schematic flow chart of another embodiment of the method for generating the gray-scale voltage of display panel of this application.

In reference to FIG. 3 which is the $2^{nd}$ embodiment of the method for generating the gray-scale voltage of display panel of this application; based on the Pt embodiment, S10 includes:

S11, determining the difference value between the two gamma voltages with their sequence number adjacent to each other, and acquiring the relationship between the target analog voltage and the gamma voltages preset with sequence number;

S12, determining the parameter of the gamma voltage generating circuit according to the voltage difference value and the relationship;

S13, causing the gamma voltage generating circuit to run according to determined parameter, and inputting the target analog voltage to the gamma voltage generating circuit so as to generate a preset number of gamma voltages.

In this embodiment, the source IC is provided with a gamma voltage generating circuit equipped with a plurality of resistances, and the source IC can input the target analog voltage to the gamma generating circuit so that the resistances in the gamma generating circuit divide the target analog voltage to obtain a preset number of gamma voltages. Specifically, the source IC acquires the difference value between the two gamma voltages with their sequence numbers adjacent to each other as well as the relationship between the target analog voltage and the gamma voltages preset with sequence number, and then determines the value of the resistances in the gamma voltage generating circuit so as to close the circuit of the resistances; each closed circuit is connected in series so as to divide the target analog voltage and obtain a preset number of gamma voltages. For instance, the gamma voltage generating circuit has 14 groups of circuit, and each group is provided with a plurality of resistances connected in parallel and allows the closure of one circuit so as to obtain a gamma voltage generating circuit in which 14 resistances are connected in series.

It can be understood that the source IC determines the parameter of gamma generating circuit according to voltage difference value and relationship; the parameter refers to the resistance value of the circuit of each group; then, the gamma voltage generating circuit is controlled to run according to the determined parameter, i.e., the circuit with the determined resistance value will be closed; next, the target analog voltage will be inputted to the gamma voltage generating circuit to obtain a preset number of gamma voltages.

Besides, an amplifying circuit and a diminution circuit may be disposed for the gamma voltage generating circuit; the source IC determines the parameter of the amplifying circuit and the diminution circuit in the gamma generating circuit in accordance with voltage difference value and relationship so that the gamma voltage generating circuit generates a preset number of gamma voltages from the inputted target analog voltage according to the amplifying circuit and the diminution circuit.

In the technical solution of the embodiment of this application, the data source integrate circuit includes a gamma voltage generating circuit; the data source integrate circuit can determine the parameter of the gamma generating circuit according to the relationship between the target analog voltage and the gamma voltages preset with sequence number as well as the difference value between the two gamma voltages with their sequence number adjacent to each other, thus causing the gamma voltage generating circuit running this parameter to generate a preset number of gamma voltages from the inputted target analog voltage, thus there is no need to use a gamma integrate circuit for generating gamma voltage and the gamma voltage will not occupy the lead in the data source integrate circuit, leading to a low cost for generating gamma voltage.

Figure 4:
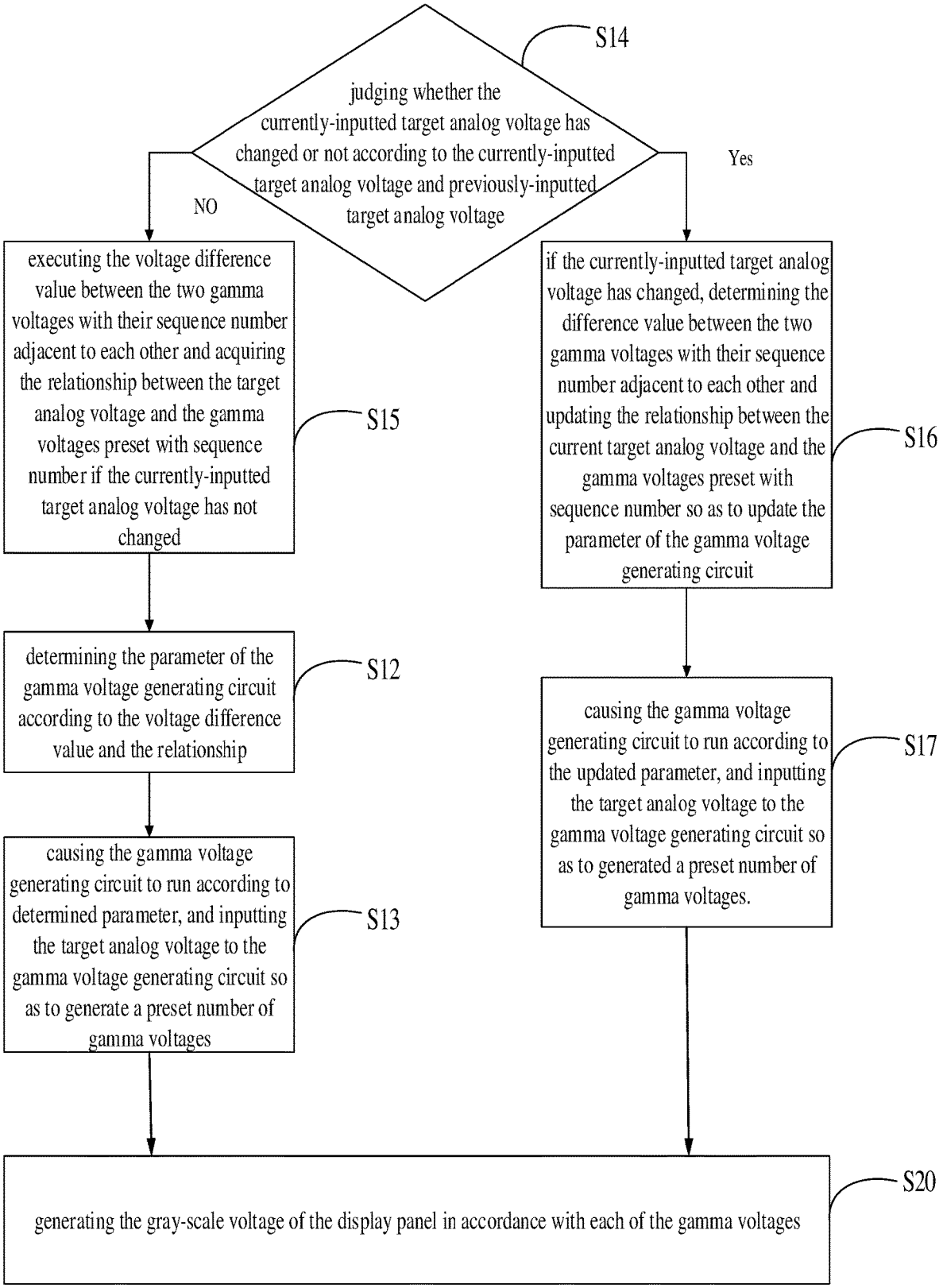
FIG. 4 is a schematic flow chart of a method for generating the gray-scale voltage of display panel according to another embodiment of the present disclosure.

In reference to FIG. 4 which is the $3^{rd}$ embodiment of the method for generating the gray-scale voltage of display panel of this application; based on the $2^{nd}$ embodiment, S10 includes:

S14, judging whether the currently-inputted target analog voltage has changed or not according to the currently-inputted target analog voltage and previously-inputted target analog voltage;

S15, executing the voltage difference value between the two gamma voltages with their sequence number adjacent to each other and acquiring the relationship between the target analog voltage and the gamma voltages preset with sequence number if the currently-inputted target analog voltage has not changed.

S16, if the currently-inputted target analog voltage has changed, determining the difference value between the two gamma voltages with their sequence number adjacent to each other and updating the relationship between the current target analog voltage and the gamma voltages preset with sequence number so as to update the parameter of the gamma voltage generating circuit;

S17, causing the gamma voltage generating circuit to run according to the updated parameter, and inputting the target analog voltage to the gamma voltage generating circuit so as to generated a preset number of gamma voltages.

When the loaded parameter on the display panel changes, the analog voltage generated by the TCON plate will fluctuate, causing the target analog voltage to fluctuate, so the gray-scale voltage generated by the source IC will be inaccurate, affecting the screen quality of display panel. Based on this, the source IC will judge whether the difference value between the currently-inputted target analog voltage and previously-inputted target analog voltage is smaller than the preset difference value or not; if so, it will judge that the currently-inputted target analog voltage has not fluctuated, and at this time, it will be ok that the source IC executes the operation S11; if the difference value is larger than or equals to the preset value, it will judge that the currently-inputted target analog voltage has fluctuated and it is necessary to adjust the generation pattern of gamma voltage; specifically, when the target analog voltage stored in the source IC fluctuates, the relationship between the target analog voltage and the gamma voltages preset with sequence number (this relationship is different from that of the case when the target analog voltage has not fluctuated) is Gamma 7+n≥HAVDD≥Gamma 8-n, wherein n may be any proper value such as 0.2; additionally, the source IC is also stored with the relationship between Gamma 7 and Gamma 1 as well as the relationship between Gamma 8 and Gamma 14;

the relationship between Gamma 7 and Gamma 1 is Gamma 1-Gamma 7=x±m, and the relationship between Gamma 8 and Gamma 14 is Gamma 8-Gamma 14=x±m, wherein x and m may be any proper value, e.g., x is 7 and m is 0.1.

The source IC will update the parameter of the gamma voltage generating circuit in accordance with the three kinds of relationship above as well as voltage difference value, causing the gamma voltage generating circuit to generate a preset number of gamma voltages.

It is to be noted that in an embodiment, the gamma voltage is generated by the digital controller in the source IC, and the digital controller will judge whether the currently-inputted target analog voltage has changed or not; if so, recoding will be conducted by adopting the three kinds of relationship as well as voltage difference value so as to generate corresponding gamma voltage.

In the technical solution provided by this embodiment, when the change of the currently-inputted target analog voltage is detected, the parameter of gamma voltage generating circuit will be updated so as to generate gamma voltage according to the changed target analog voltage and precisely generate the gray-scale voltage of display panel.

This application also provides a display panel including a data source integrate circuit, the data source integrate circuit includes at least one processor and a storage device.

The memory is stored with a computer-executable command that can be executed by at least one processor, and when the computer-executable command is executed by at least one processor, one processor will execute the following operations of:

inputting the target analog voltage to the digital controller when the data source integrate circuit detects the inputted target analog voltage so that the digital controller generates a preset number of gamma voltages according to the target analog voltage; and generating the gray-scale voltage of display panel according to each of the gamma voltages.

This application also provides a computer-readable storage medium stored with a computer-executable command that can be executed by at least one processor; when the computer-executable command is executed by at least one processor, one processor will execute the following operations of:

generating, by a data source integrate circuit, a preset number of gamma voltages according to target analog voltage when an inputted target analog voltage is detected; and generating the gray-scale voltage of the display panel in accordance with each gamma voltage.

The sequence number in the above-mentioned embodiment of this application is only for description and does not mean that the embodiments are superior or inferior.

It is to be noted that the terms 'include', 'comprise' and any other variants herein are intended as a non-exclusive coverage, thus the process, method, article or device comprising a series of elements comprises not only such elements but those that have not been clearly listed, or further comprises the inherent elements of such process, method, article or device. When not further limited, the element defined by the statement 'comprising a . . . ' does not exclude other identical elements in such process, method, article or device.

From the description of the embodiments above, the artisans concerned can clearly know that the method of the aforementioned embodiments can be realized by software and necessary common hardware platform, or undoubtedly, by hardware; however, in most cases, the former is preferred. Based on such understanding, the essence of this application or the part making contribution to existing technology may be presented in the form of software products stored in a storage medium (e.g., ROM/RAM, floppy disk, optical disk), including a plurality of commands to cause a terminal equipment (e.g., mobile phone, computer, server, television or network equipment, etc.) to execute the method described in each embodiment of this application.

The description above is merely an optional embodiment of this application and does not constitute any limitation; any equivalent structural or procedural changes made on the basis of the specification and accompanying drawings of this application as well as any direct or indirect application to other related fields shall be included in the scope of claims of this application likewise.

What is claimed is:

1. A method for generating a gray-scale voltage of a display panel, wherein the method comprises:

generating, by a data source integrate circuit, a preset number of gamma voltages according to a target analog voltage when an inputted target analog voltage is detected; and generating the gray-scale voltage of the display panel in accordance with each gamma voltage;

wherein the data source integrate circuit comprises a gamma voltage generating circuit, and the operation of generating the preset number of gamma voltages according to the target analog voltage comprises:

determining a voltage difference value between two gamma voltages with sequence numbers adjacent to each other, and acquiring a relationship between the target analog voltage and the gamma voltages preset with sequence numbers;

determining a parameter of the gamma voltage generating circuit according to the voltage difference value and the relationship; and controlling the gamma voltage generating circuit to run according to determined parameter, and inputting the target analog voltage to the gamma voltage generating circuit, enabling the gamma voltage generating circuit to generate the preset number of gamma voltages according to the voltage difference value and the relationship.

2. The method according to claim 1, wherein the data source integrate circuit comprises a digital controller, and the operation of generating the preset number of gamma voltages according to the target analog voltage comprises:

inputting the target analog voltage to the digital controller, enabling the digital controller to generate the preset number of gamma voltages according to the target analog voltage.

3. The method according to claim 2, wherein before the operation of inputting the target analog voltage to the digital controller, the method further comprises:

writing into the digital controller a relationship between the target analog voltage and the gamma voltage preset with a sequence number as well as the voltage difference value between the two gamma voltages with sequence numbers adjacent to each other.

4. The method according to claim 3, wherein the relationship between the target analog voltage and the gamma voltages preset with sequence numbers comprises:

a $1^{st}$ gamma voltage is larger than the target analog voltage, and the target analog voltage is larger than a $2^{nd}$ gamma voltage.

5. The method according to claim 1, wherein the operation of generating the preset number of gamma voltages according to the target analog voltage comprises:

judging whether a currently-inputted target analog voltage has changed or not according to the currently-inputted target analog voltage and a previously-inputted target analog voltage; and when the currently-inputted target analog voltage has not changed according to the currently-inputted target analog voltage and the previously-inputted target analog voltage, executing the voltage difference value between the two gamma voltages with sequence numbers adjacent to each other and acquiring the relationship between the target analog voltage and the gamma voltages preset with sequence numbers.

6. The method according to claim 5, wherein after the operation of judging whether the currently-inputted target analog voltage has changed or not according to the currently-inputted target analog voltage and previously-inputted target analog voltage, the method further comprises:

when the currently-inputted target analog voltage has changed according to the currently-inputted target analog voltage and the previously-inputted target analog voltage, determining the difference value between the two gamma voltages with sequence numbers adjacent to each other and updating the relationship between the current target analog voltage and the gamma voltages preset with sequence numbers, for updating the parameter of the gamma voltage generating circuit; and controlling the gamma voltage generating circuit to run according to the updated parameter, and inputting the target analog voltage to the gamma voltage generating circuit, for generating the preset number of gamma voltages.

7. The method according to claim 1, wherein the gamma voltage generating circuit comprises a plurality of groups of circuit, the circuit comprises a plurality of resistances connected in parallel, and the parameter comprises a resistance value of the circuit.

8. The method according to claim 1, wherein the relationship comprises a relationship of a $1^{st}$ gamma voltage, a $2^{nd}$ gamma voltage and the target analog voltage, a relationship between a $3^{rd}$ gamma voltage and the $1^{st}$ gamma voltage, and a relationship between the $2^{nd}$ gamma voltage and a $4^{th}$ gamma voltage.

9. The method according to claim 8, wherein the relationship of the $1^{st}$ gamma voltage, the $2^{nd}$ gamma voltage and the target analog voltage comprises:

a result of subtracting the $1^{st}$ gamma voltage from the target analog voltage is smaller than or equal to a $1^{st}$ value, and a result of subtracting the target analog voltage from the $2^{nd}$ gamma voltage is smaller than or equal to the $1^{st}$ value, and the $1^{st}$ value is a positive number.

10. The method according to claim 8, wherein the relationship between the $3^{rd}$ gamma voltage and the $1^{st}$ gamma voltage comprises:

a result of subtracting the $1^{st}$ gamma voltage from the $3^{rd}$ gamma voltage is larger than or equal to a difference between a $2^{nd}$ value and a $3^{rd}$ value, and is smaller than or equal to a sum of the $2^{nd}$ value and the $3^{rd}$ value, and the $2^{nd}$ value is larger than the $3^{rd}$ value, and both the $2^{nd}$ value and the $3^{rd}$ value are positive numbers.

11. The method according to claim 10, wherein the relationship between the $2^{nd}$ gamma voltage and the $4^{th}$ gamma voltage comprises:

a result of subtracting the $4^{th}$ gamma voltage from the $2^{nd}$ gamma voltage is larger than or equal to the difference between the $2^{nd}$ value and the $3^{rd}$ value, and is smaller than or equal to the sum of the $2^{nd}$ value and the $3^{rd}$ value.

12. The method according to claim 1, wherein the operation of generating the gray-scale voltage of display panel according to each gamma voltage comprises:

inputting each of the gamma voltages to a resistance string of the data source integrate circuit so as to generate the gray-scale voltage of the display panel.

13. The method according to claim 1, wherein the target analog voltage is a half of an analog voltage.

14. The method according to claim 1, wherein the preset number is 14.

15. A display panel comprising a data source integrate circuit comprising at least one processor and a memory device, wherein:

the memory device stores a computer-executable instruction executable by the at least one processor, one processor performs the following operations when the computer-executable instruction is executed by the at least one processor:

generating, by a data source integrate circuit, a preset number of gamma voltages according to a target analog voltage when an inputted target analog voltage is detected; and generating the gray-scale voltage of the display panel in accordance with each gamma voltage wherein the data source integrate circuit comprises a gamma voltage generating circuit, and the operation of generating the preset number of gamma voltages according to the target analog voltage comprises:

determining a voltage difference value between two gamma voltages with sequence numbers adjacent to each other, and acquiring a relationship between the target analog voltage and the gamma voltages preset with sequence numbers;

determining a parameter of the gamma voltage generating circuit according to the voltage difference value and the relationship; and controlling the gamma voltage generating circuit to run according to determined parameter, and inputting the target analog voltage to the gamma voltage generating circuit, enabling the gamma voltage generating circuit to generate the preset number of gamma voltages according to the voltage difference value and the relationship.

16. The display panel according to claim 15, wherein one processor performs the following operations when the computer-executable instruction is executed by the at least one processor:

writing into the digital controller a relationship between the target analog voltage and the gamma voltages preset with a sequence number as well as the voltage difference value between the two gamma voltages with sequence numbers adjacent to each other.

17. The display panel according to claim 15, wherein one processor performs the following operations when the computer-executable instruction is executed by the at least one processor:

inputting each of the gamma voltages to a resistance string of the data source integrate circuit so as to generate the gray-scale voltage of the display panel.

18. A computer-readable storage medium, wherein the computer-readable storage medium stores a computer-executable command executable by at least one processor, and when the computer-executable command is executed by at least one processor, one processor executes the following operations:

generating, by a data source integrate circuit, a preset number of gamma voltages according to a target analog voltage when an inputted target analog voltage is detected; and generating the gray-scale voltage of the display panel in accordance with each gamma voltage;

wherein the data source integrate circuit comprises a gamma voltage generating circuit, and the operation of generating the preset number of gamma voltages according to the target analog voltage comprises:

determining a voltage difference value between two gamma voltages with sequence numbers adjacent to each other, and acquiring a relationship between the target analog voltage and the gamma voltages preset with sequence numbers;

determining a parameter of the gamma voltage generating circuit according to the voltage difference value and the relationship; and controlling the gamma voltage generating circuit to run according to determined parameter, and inputting the target analog voltage to the gamma voltage generating circuit, enabling the gamma voltage generating circuit to generate the preset number of gamma voltages according to the voltage difference value and the relationship.

* * * * *